US005725325A

United States Patent [19]

Schleiter et al.

[11] Patent Number: 5,725,325

[45] Date of Patent: Mar. 10, 1998

[54] LAYING PLANK FOR A ROAD FINISHER

[75] Inventors: Burkhard Schleiter, Oldenburg; Klaus Dieter Bunk, Grossenkneten, both of Germany

[73] Assignee: Svedala Strassenfertiger GmbH, Wardenburg, Germany

[21] Appl. No.: 466,195

[22] Filed: Jun. 6, 1995

[30] Foreign Application Priority Data

Jun. 8, 1994 [DE] Germany ..... 44 20 016.1

[51] Int. Cl.[6] ..... E01C 19/48

[52] U.S. Cl. ..... 404/118; 404/104

[58] Field of Search ..... 404/101, 104, 404/118, 119

[56] References Cited

U.S. PATENT DOCUMENTS

| | | | |
|---|---|---|---|
| 4,129,399 | 12/1978 | Ruge | 404/118 |
| 4,272,213 | 6/1981 | McGovarin | 404/104 X |
| 4,969,773 | 11/1990 | Heims | 404/118 |
| 4,986,695 | 1/1991 | Heims | 404/104 X |
| 4,991,995 | 2/1991 | Heims | 404/118 |

FOREIGN PATENT DOCUMENTS

| | | | |
|---|---|---|---|
| 367893 | 5/1990 | European Pat. Off. . | |
| 367894 | 5/1990 | European Pat. Off. . | |
| 369095 | 5/1990 | European Pat. Off. . | |
| 2621558 | 12/1977 | Germany . | |
| 2709435 | 9/1978 | Germany | 404/118 |
| 3838157 | 5/1990 | Germany . | |
| 4208883 | 7/1993 | Germany . | |
| 4229464 | 3/1994 | Germany . | |
| 2250529 | 6/1992 | United Kingdom | 404/118 |

*Primary Examiner*—James Lisehora

*Attorney, Agent, or Firm*—Sughrue, Mion, Zinn, Macpeak & Seas

[57] ABSTRACT

Disclosed are laying planks (11) which allow a variation of the working width of the road finisher and are comprised of a main plank and two displacement planks (13) disposed displaceably on opposite ends of the main plank. For a more precise guidance and more stable mounting of the displacement planks (13) on the main plank, it is known to arrange intermediate slides (14) between the main plank and the displacement plank (13). However, these intermediate slides (14) do not allow a full extension of the displacement planks (13) relative to the main plank. According to the invention, the intermediate slides (14) have guide rods (26, 27) which project from outer end face plates (20) of the intermediate slides (14). As a result, the displacement planks (13) can be extended beyond the region of the main plank over their entire width. In displacement planks (13) which are usually half the width of the main plank, it is thus possible to double the width of the laying plank (11) when the displacement planks (13) are fully extended.

4 Claims, 4 Drawing Sheets

LAYING PLANK FOR A ROAD FINISHER

BACKGROUND OF THE INVENTION

The invention relates to a laying plank for a road finisher.

The working width of road finishers is usually widened by so-called displacement planks which are mounted at opposite ends of the main plank in a laterally extendable manner. The mounting of the displacement planks on the main plank must be of sufficient stability to prevent the displacement planks from tilting relative to the main plank.

In order to avoid the disadvantages mentioned above, it is already known from DE 42 08 883 A1 to mount the displacement planks on the main plank with intermediate slides. As a result, it is possible to shorten the lengths of the individual guides and to reduce an "inherent dynamics" of the displacement planks with respect to the main plank. Although this prior art laying plank has proved itself in practice, it does not allow a full extension of the displacement plank with respect to the main plank. In the fully extended position, a small end portion of the displacement plank always overlaps with a respective end portion of the main plank. As a result, it is not possible to extend the laying plank to twice the width of the main plank.

SUMMARY OF THE INVENTION

It is the object of the invention to provide a laying plank which allows an enlargement of the working width by the full width of each displacement plank.

As a result of projecting guide means on the intermediate slides, the guide means associated with the intermediate slides project beyond the outer ends of the main plank when the intermediate slides are moved to the ends of the main plank. In this way, the guide means practically form "jibs" of the intermediate slides which allow the displacement planks to fully extend from the region of the main plank, and in particular to such an extent, that confronting end portions of the main plank and the respective displacement plank do not overlap at all.

In a preferred embodiment of the invention, the guide means project at least from those outer end face plates of the intermediate slides which are directed towards the ends of the main plank. At the point where the guide means of the prior art device according to DE 42 08 883 A1 end, the guide means of the invention, which project from the outer end face plate of the respective intermediate slide like a supporting arm, effect an extension of the guide means of the intermediate slide, by means of which the displacement planks are extendable beyond the outer end plates of the main plank.

According to a further development of the invention, the guide means are connected with the intermediate slides at opposite ends. In this way, the full length of its guide means is available for the displacement of the displacement planks. Preferably, the guide means are attached indirectly to the intermediate slides by supporting means which are tightly connected to inner and outer end face plates of the intermediate slides. End flaps at the ends of the supporting means serve for attaching the ends of the guide means. As a result of this type of attachment, it is possible to attach the guide means to the intermediate slides in a twist-free manner and to move the inner plates of the displacement planks past the outer end face plates of the intermediate slides.

A preferred exemplary embodiment of the invention will be described hereinafter in more detail with respect to the drawings, in which:

DESCRIPTION OF A PREFERRED EMBODIMENT

Figure 1:
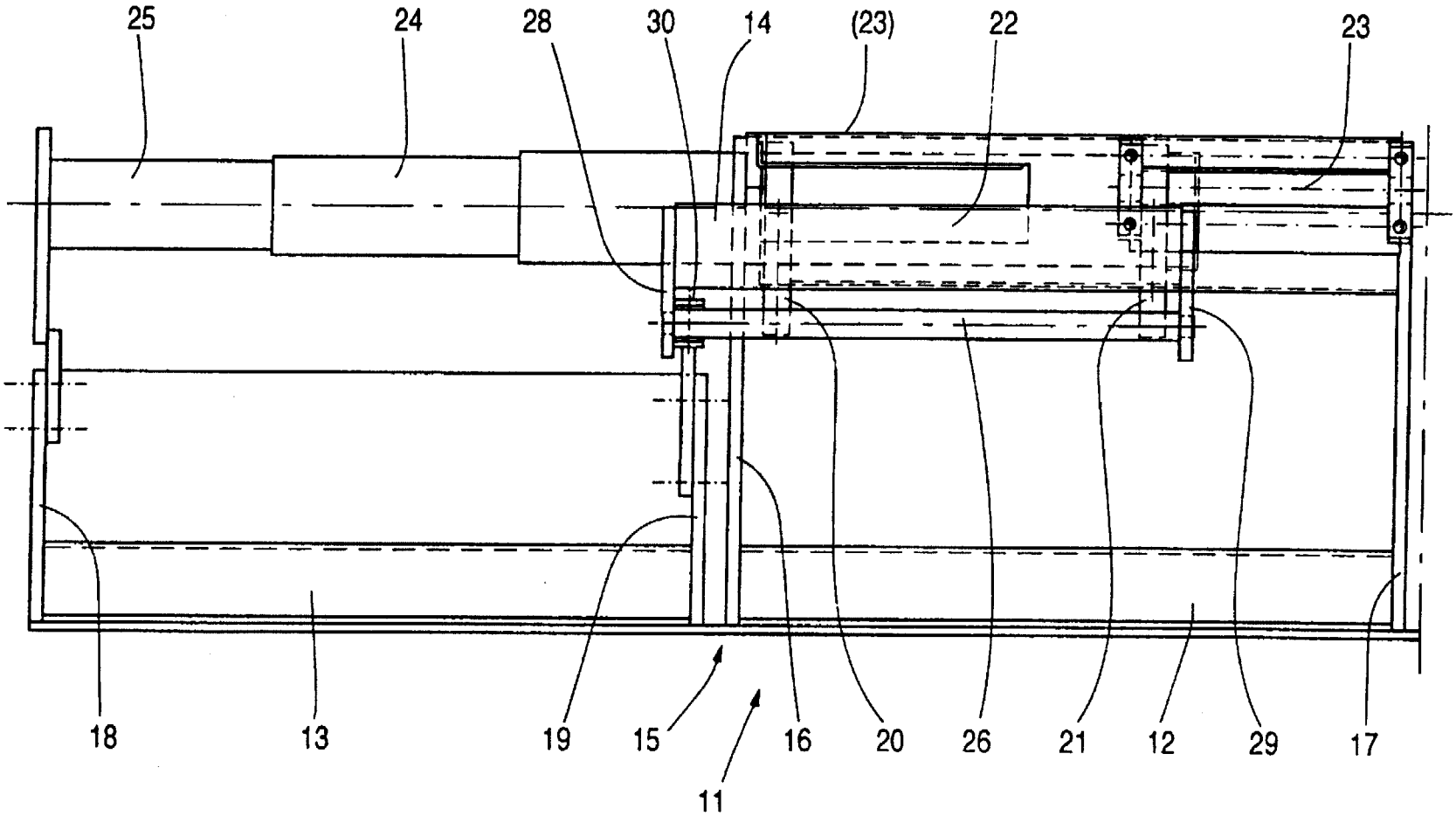
FIG. 1 shows a view of a (left) extended half of the laying plank as seen from its rear side (with respect to the finishing direction)

The figures show a left half of a laying plank 11, as seen from the rear with respect to the finishing direction 10, of a road finisher whose other components are not shown. The laying plank is coupled behind the road finisher with respect to the finishing direction 10.

The laying plank 11 is comprised of a centrally divided main plank of which only a left half is shown in the Figures. If required, both halves of the laying plank 11 can be connected to one another. The (left) main plank half 12 is provided with a displacement plank 13. The (right) main plank half, which is not shown in the drawings, also has a displacement plank. The displacement plank 13 is mounted on the main plank half 12 via an intermediate slide 14.

Figure 3:
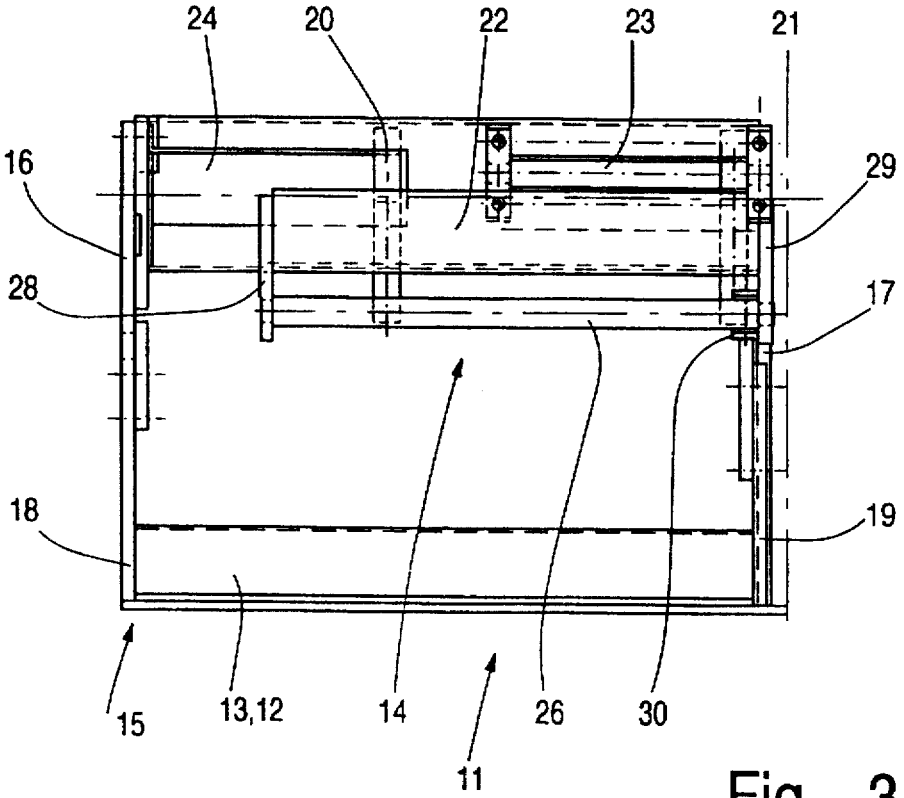
FIG. 3 shows the left half of the laying plank in the retracted position in a view according to FIG. 1.
Figure 4:
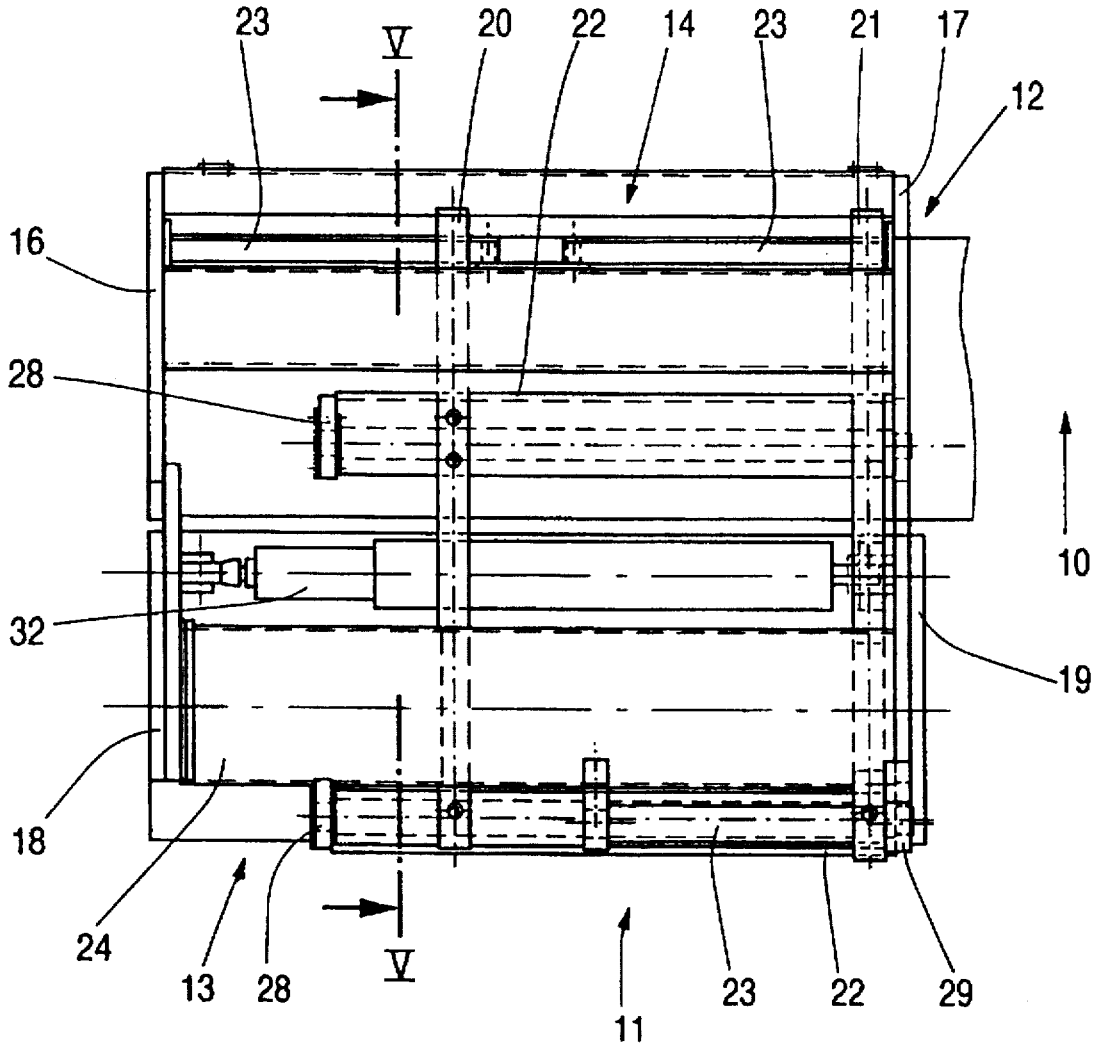
FIG. 4 shows a top view of the half of the laying plank according to FIG. 3.

The main plank half 12 and the displacement plank 13 are of approximately the same width. The displacement plank 13 is displaceable with respect to the main plank half 12 transversely relative to the finishing direction 10. In particular, the displacement plank is extendable into the position shown in FIGS. 1 and 2 and rectractable into the position shown in FIGS. 3 and 4. In the extended position, the displacement plank 13 doubles the width of the main plank half 12.

The main plank half 12 has an outer end plate 16 at its outer end 15. The oppositely situated end of the main plank half 12, which end is directed towards the longitudinal mid-axis of the road finisher, has an inner end plate 17. The end plates 16 and 17 are connected rigidly to one another. The displacement plank 13 has an outer plate 18 and an inner plate 19. The outer plate 18 and inner plate 19 are also rigidly connected to one another. The intermediate slide 14 has an outer end face plate 20 directed towards the outer end 15 of the main plank half 12 and an inner end face plate 21 directed towards the inner end plate 17 of the main plank half 12. The outer end face plate 20 and the inner end face plate 21 of the intermediate slide 14 are connected, inter alia, by two supporting means in the form of oppositely situated profiled rails 22. The intermediate slide 14 is mounted, at the opposite sides of its outer end face plates 20 and its inner end face plate 21, to guides 23 which are firmly connected to the main plank half 12. As a result, the intermediate slide 14 is displaceable transversely relative to the finishing direction 10 between the inner end plate 17 and the outer end plate 16 of the main plank half 12. For this purpose, the distance between the outer end face plate 20 and the inner end face plate 21 of the intermediate slide 14 is smaller than the distance between the outer end plate 16 and the inner end plate 17 of the main plank half 12.

A telescopic guide tube 24 is attached to the intermediate slide 14, in particular between the outer end face plate 20 and the inner end face plate 21 of the intermediate slide. An extendable end 25 of the telescopic guide tube 24 is firmly connected to the outer plate 18 of the displacement plank 13. As a result, the displacement plank 13 is guided on the outer plate 18 by the telescopic guide tube 24. Furthermore, a pressure medium cylinder 32 is disposed between the inner end plate 17 of the main plank half 12 and the outer plate 18 of the displacement plank 13. This pressure medium cylinder serves for extending and retracting the displacement plank 13 relative to the plank half 12, simultaneously (automatically) taking along the intermediate slide 14. The inner plate 19 of the displacement plank 13 is mounted displaceably on guide means of the intermediate slide 14 in the form of guide rode 26 and 27.

Figure 2:
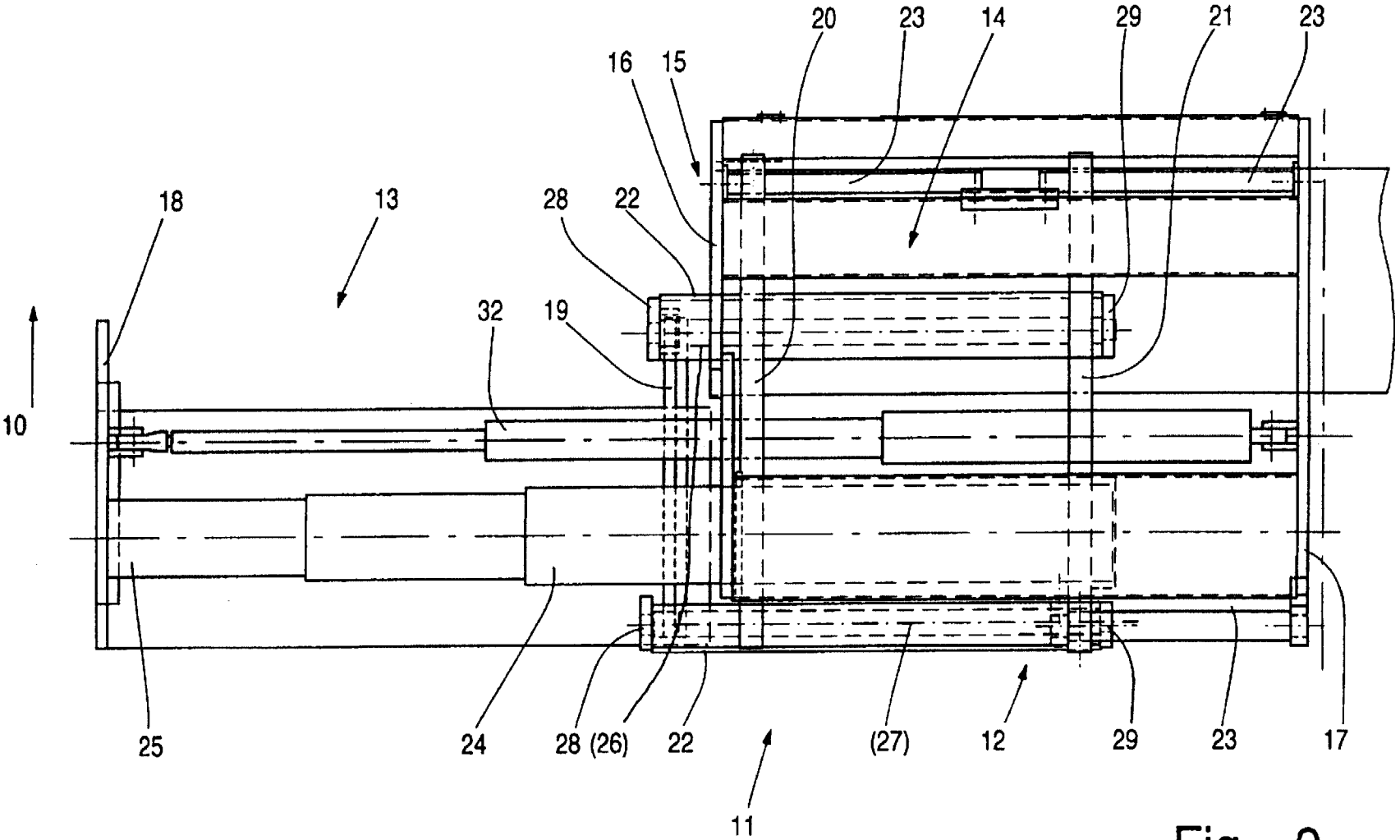
FIG. 2 shows a top view of the extended half of the laying plank according to FIG. 1.

According to the invention, the guide rods 26 and 27 project from the outer end face plate 20 of the intermediate slide 12, which end face plate is directed towards the outer end plate 16 of the main plank half 12 (FIGS. 1 and 2). The length by which the guide rode 26 and 27 project relative to the outer end face plates 20 of the intermediate slide 14 is selected such that, when the displacement plank 13 is in the extended position, the inner plate 19 thereof is moved to the outside relative to the outer wall of the outer end plate 16 of the main plank half 12, such that the entire displacement plank 13 i.e. located laterally next to the outer end 15 of the main plank half 12, which end 15 is formed from the outer end plate 16 of the main plank half 12 (FIGS. 1 and 2). The combined length of the respective guide rod 26 and 27 on the intermediate slide 14 and of the respective guide 23 for the intermediate slide 14 on the main plank half 12 corresponds to the width of the displacement plank 13 or slightly exceeds this width. As a result, by way of moving the intermediate slide 14 on the main plank half 12, and the displacement plank 13 on the intermediate slide 14, it is possible to extend the displacement plank 13 by its full width beyond the main plank half 12, such that the width of the laying plank corresponds to double the width of the main plank when the displacement planks are fully extended.

The guide rods 26 are attached indirectly to the intermediate slide 14 via the profiled rails 22. The profiled rails 22 which, in the exemplary embodiment shown, take the form of an L-profile, are provided with an end flap 28 and 29 at their opposite ends. The guide rods 26 and 27 are attached between 2O the end flaps 28 and 29 of the profiled rails 22, with the ends of the guide rod 26 and 27 being connected to one end flap 28 and 29, respectively. The guide rods 26 and 27 are connected to the outer end face plate 20 and the inner end face plate 21 of the intermediate slide 14 via the profiled rails 22. The distance between the outer end face plate 20 and the inner end face plate 21 of the intermediate slide 14 is smaller than the length of the profiled rails 22 and the guide rods 26 and 27. The profiled rails 22 clearly project relative to the outer end face plate 20 directed towards the outer end 15 of the main plank half 12. As a result, the guide rods 26 and 27 also project, like a supporting arm, relative to the outer end face plates 20. The distance between the outer ends of the guide rods 26 and 27 and the outer wall of the outer end face plate 20 of the intermediate slide 14 is slightly greater than the thickness of the outer end plate 16 of the main plank half 12 and the inner plate 19 of the displacement plank 13 (FIG. 2). In the exemplary embodiment shown, the ends of the profiled rails 22 and the guide rods 26 and 27 supported thereon also slightly project relative to the wall of the inner end face plate 21 of the intermediate slide 14, which wall is directed towards the inner end plate 17 of the main plank half 12. Alternatively, however, the ends of the guide rods 26 and 27 and of the profiled rails 22 could be flush with the wall of the inner end face plate 21 of the intermediate slide 14, which wall is directed towards the inner end plate 17 of the main plank half 12.

Figure 5:
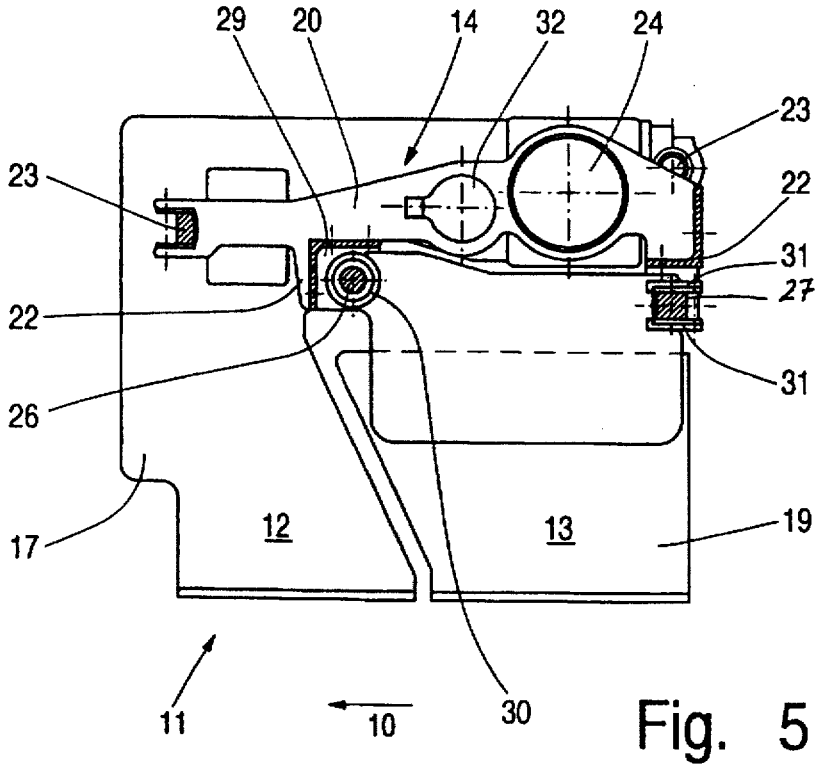
FIG. 5 shows a section V—V taken along the (left) half of the laying plank according to FIG. 4.

The displacement plank 13 is mounted displaceably on the guide rods 26 and 27 with its inner end face plate 21. In the exemplary embodiment shown, the (first) guide rod 26 has a circular cross section. For this purpose, a guide sleeve 30 whose cross section corresponds to that of the guide rod 26 is attached at the inner plate 19 of the displacement plank 13. In the exemplary embodiment shown, the (second) guide rod 27 has an approximately quadratic cross section. Oppositely situated (horizontal) guide faces of the guide rod 27 are associated with parallel (plane) guide faces 31 which are firmly connected with the inner plate 19 of the displacement plank 13 (FIG. 5). Furthermore, FIG. 5 shows that the cross section of the displacement plank 13 is adjusted to the cross section of the main plank half 12 in such a way that the displacement plank 13 is freely moveable with the outer plate 18 and the inner plate 19 past the outer end plate 16 of the main plank half 12.

The (right) main plank half of the laying plank 11, which half is not shown in the drawings, is constructed in an analogous manner—but with a mirror-symmetrical arrangement—with respect to the left half of the laying plank 11 described above.

What is claimed is:

1. A laying plank for a road finisher, comprising:

a longitudinally extending main plank which has two transversely opposite ends and respective end plate connected thereto;

two displacement planks which are associated with the opposite ends of the main plank, and which are provided with respective inner plates directed towards the main plank;

two intermediate slides for displaceably mounting said two displacement planks transversely to the main plank;

two spaced apart outer and inner end plates on each intermediate slide;

guides which are within the main plank, and along which said end plates of the intermediate slides are displaceable transversely to the main plank;

supporting members which connect the end plates of the intermediate slides to one another; and guide members on the intermediate slides, said guide members being connected to said supporting members of the intermediate slides; and said inner plates of the displacement planks being displaceably mounted on said guide members, wherein said supporting members and said guide members project from an outer end plate of each intermediate slide to such an extent that, when said displacement planks are fully extended, said inner plates of said displacement planks project from said end plates of said main plank.

2. The laying plank according to claim 2, wherein opposite ends of the supporting members have end flaps (28, 29) with which ends of the guide members are connected.

3. The laying plank according to claim 2, wherein supporting members comprise L-shaped rails (22).

4. The laying plank according to claim 3, wherein the guide members comprise guide rods (26,27).

* * * * *